US008567930B2

(12) United States Patent
Ogle et al.

(10) Patent No.: US 8,567,930 B2
(45) Date of Patent: Oct. 29, 2013

(54) INK CONTAINER SUPPORTS

(75) Inventors: Holli C. Ogle, Corvalis, OR (US); Christian Bernhard Sturm, Barcelona (ES); Martin Urrutia Nebreda, Barcelona (ES); Marc Bautista Palacios, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 195 days.

(21) Appl. No.: 12/993,761

(22) PCT Filed: May 20, 2008

(86) PCT No.: PCT/US2008/064208

§ 371 (c)(1),
(2), (4) Date: Nov. 19, 2010

(87) PCT Pub. No.: WO2009/142623

PCT Pub. Date: Nov. 26, 2009

(65) Prior Publication Data

US 2011/0063387 A1 Mar. 17, 2011

(51) Int. Cl.
*B41J 2/175* (2006.01)

(52) U.S. Cl.
USPC ..... 347/86; 347/49; 347/84; 347/85; 347/108; 399/258

(58) Field of Classification Search
None
See application file for complete search history.

(56) References Cited

U.S. PATENT DOCUMENTS 5,138,344 A 8/1992 Ujita
6,003,985 A * 12/1999 Bekki ..... 347/86
6,206,510 B1 3/2001 Casserino et al.
6,305,785 B1 10/2001 Hosaka et al.
6,416,166 B1 * 7/2002 Robinson et al. ..... 347/49
6,488,369 B1 12/2002 Steinmetz et al.
6,571,076 B2 5/2003 Kasahara
7,152,965 B2 * 12/2006 Ishizawa et al. ..... 347/86
7,784,923 B2 * 8/2010 Ishizawa et al. ..... 347/85
2002/0015608 A1 2/2002 Williams et al.
2006/0007284 A1 * 1/2006 Shimizu ..... 347/86
2006/0203045 A1 9/2006 Kobayashi et al.
2007/0242982 A1 10/2007 Sudo

FOREIGN PATENT DOCUMENTS

EP 0412459 A2 2/1991
EP 0832747 A2 4/1996
EP 0710568 A2 5/1996
EP 1346834 A2 9/2003

OTHER PUBLICATIONS http://www.bing.com/Dictionary/search?q=definition+panel&qs=n&form=QB Dec. 27, 2012.*
http://www.bing.com/Dictionary/search?q=definition+interface&qs=n&form=QB Dec. 27, 2012.*
http://www.bing.com/Dictionary/search?q=definition+support&qs=n&form=QB Dec. 27, 2012.*
Search report (extended and supplementary) in EP counterpart patent application 08755940.7, dated Apr. 4, 2011.

* cited by examiner

*Primary Examiner* — Matthew Luu
*Assistant Examiner* — John P Zimmermann

(57) ABSTRACT

In one embodiment, an ink container support includes a support tray adapted to support an ink container, and a front panel associated with the support tray, the front panel being adapted to facilitate user interfacing with the ink container when supported by the support tray.

12 Claims, 3 Drawing Sheets

INK CONTAINER SUPPORTS

BACKGROUND

Ink is often supplied in large format printers using plastic containers. For example, the printer may comprise a rack upon which one or more cylindrical plastic ink bottles can be supported.

Currently under development are bag-in-box type ink containers in which a pliable plastic bag that is filled with liquid ink is contained within a corrugated fiberboard carton. Due to the unique features of such containers, it would be desirable to have unique ink containers support that can support the ink containers and facilitate convenient user interfacing with the ink containers.

BRIEF DESCRIPTION OF THE DRAWINGS

The disclosed ink container supports can be better understood with reference to the following drawings. The components in the drawings are not necessarily to scale.

DETAILED DESCRIPTION

Disclosed herein are ink container supports that are adapted to support bag-in-box ink containers within or in association with a large format printer. In some embodiments, an ink container support comprises a support tray within which the ink container can be placed. In addition, the ink container support comprises a front panel that facilitates convenient user interfacing with the ink container and a supply connector that is used to deliver ink from the container to the printing mechanism of the printer.

Figure 1:
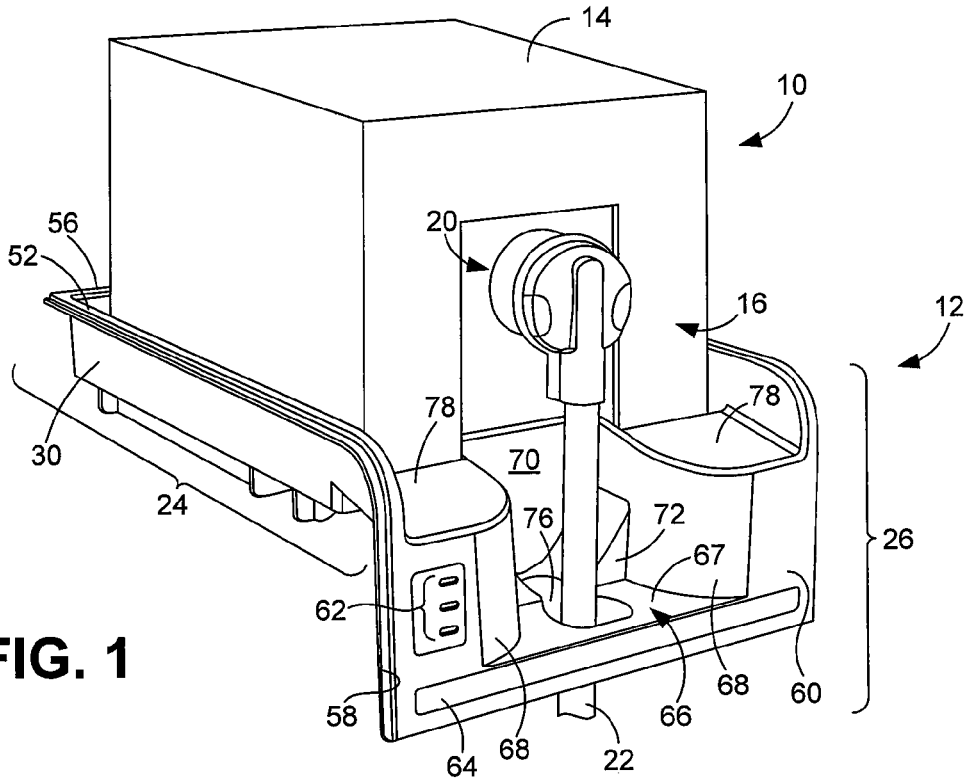
FIG. 1 is a perspective view of an ink container supported by an ink container support, with a supply connector shown connected to the ink container.
Figure 2:
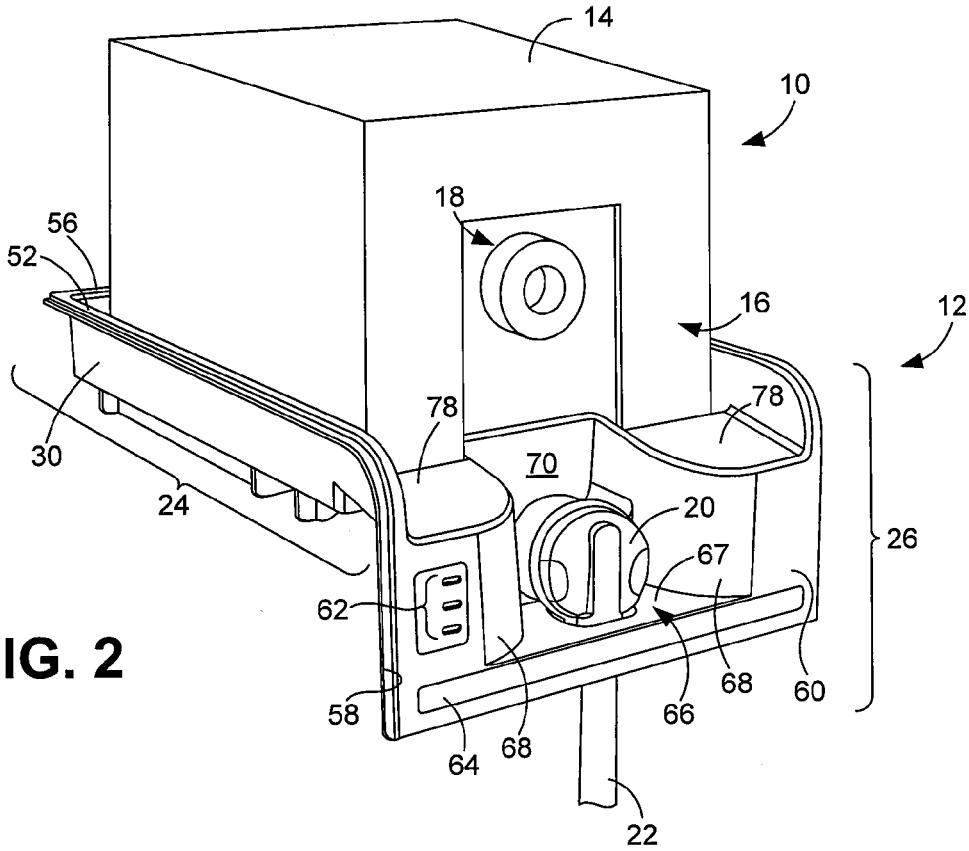
FIG. 2 is a further perspective view of the ink container and the ink container support of FIG. 1, with the supply connector shown disconnected from the ink container and supported by the ink container support.

Referring now in more detail to the drawings in which like numerals identify corresponding parts throughout the views, FIGS. 1 and 2 illustrate a bag-in-box ink container 10 supported by an ink container support 12. As is apparent from those figures, the ink container 10 comprises a box-shaped outer carton 14, which contains an internal ink containment bag (not visible). In some embodiments, the carton 14 is constructed of a corrugated fiberboard material, commonly called cardboard. Irrespective of the material from which it is made, the carton 14 comprises multiple sides, including a front side 16 at which an outlet port 18 (FIG. 2) can be accessed. In FIG. 1, a supply connector 20 is shown connected to the port 18 such that ink contained within the internal ink containment bag can flow out from the container 10, through the connector, and into a supply tube 22 that is connected to a printer to which the ink is to be provided. In FIG. 2, the supply connector 20 is shown disconnected from the port 18 and, as described below, is supported by the ink container support 12.

Figure 3:
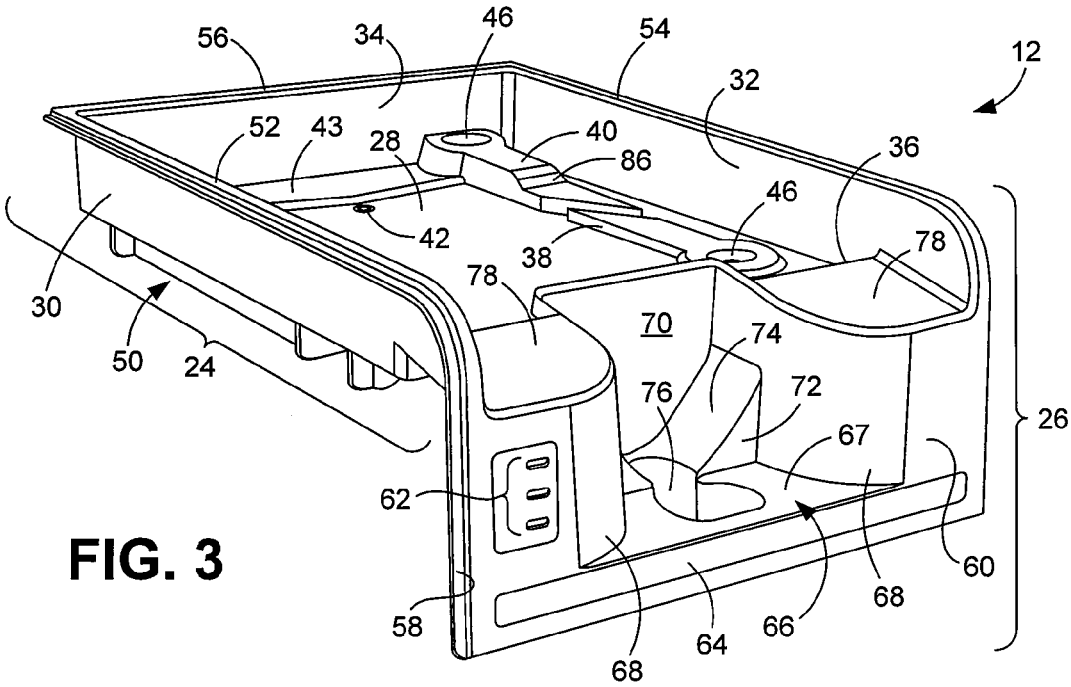
FIG. 3 is a further perspective view of the ink container support shown in FIG. 1, with the ink container and the supply connector removed.
Figure 4:
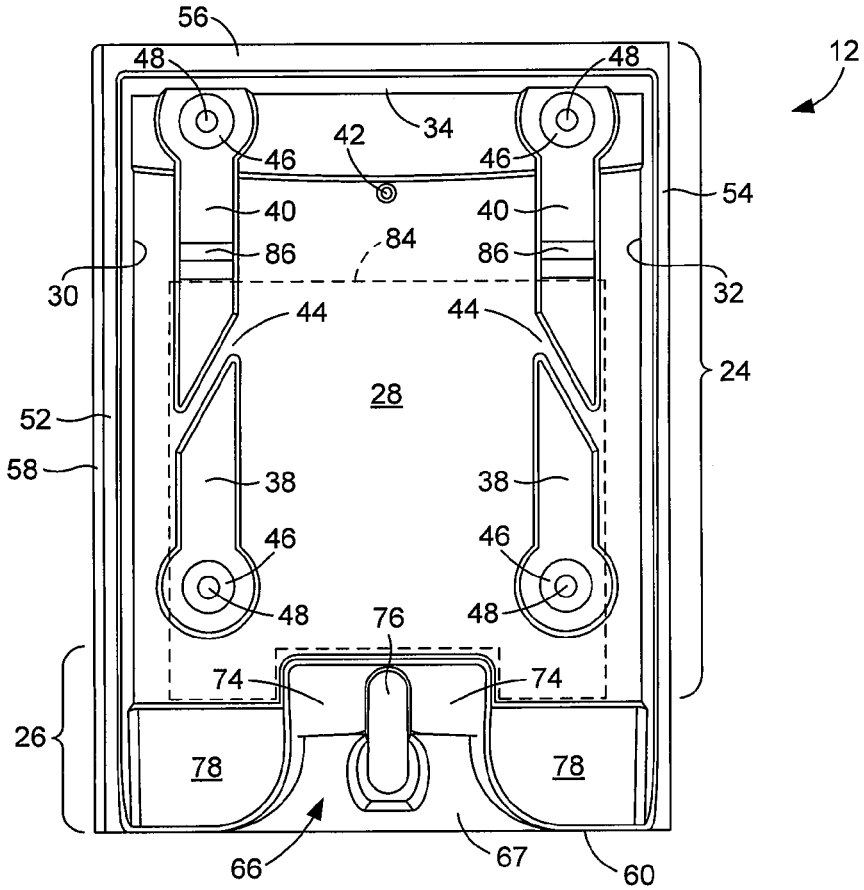
FIG. 4 is a top view of the ink container support shown in FIG. 1.

FIGS. 3 and 4 illustrate an example configuration for the ink container support 12. As shown in that figure, the ink container support 12 generally comprises a support tray 24 used to physically support the ink container 10 and a front panel 26 with which a user may interface. In some embodiments, the support tray 24 and the front panel 26 are unitarily formed from the same piece of material, such as a plastic material. Such construction can, for example, be achieved by forming the ink container support 12 using an injection molding process.

As is further shown in FIGS. 3 and 4, the support tray 24 includes a base or pan 28 and a plurality of walls that extend upward from the pan at its peripheral edges. In the illustrated embodiment, those walls include a left wall 30, a right wall 32, a rear wall 34, and a front wall 36 that is at least partly formed by the front panel 26. Also extending upward from the pan 28 are container support elements, including two front support elements 38 and two rear support elements 40 (see FIG. 4). The support elements 38, 40 support the ink container 10 above the surface of the pan 28 so that, in case of a leak, ink can flow out down to a central portion of the pan that includes a drain hole 42 through which the leaked ink can be drained from the pan and deposited in a suitable receptacle. In some embodiments, the pan 28 is sloped such that ink will naturally flow toward the drain hole 42 when it falls onto the pan. Positioned between the drain hole 42 and the rear wall 34 is a rear sloped element 43, which is also configured to direct leaked ink to the pan 28 and the drain hole.

In the illustrated embodiment, each support element 38, 40 comprises a circular portion and a linear portion that extends from the circular portion toward the center of the pan 28. As indicated most clearly in FIG. 4, the linear portions of the left side pair of elements 38, 40 and the right side pair of elements 38, 40 are each separated by a diagonal channel 44 that enables ink that drips into the pan 28 adjacent the left and right walls 30, 32 to flow toward the center of the pan 28 and, ultimately, to the drain hole 42. As is further indicated in FIG. 4, provided within each circular portion is a recess 46. Each recess 46 surrounds a mounting hole 48 through which a fastener, such as a bolt, can be passed to secure the ink container support 12 to a printer. As is further indicated in FIG. 3, the support tray 24 further comprises a support structure 50 that underlies and provides structural rigidity to the pan 28.

With further reference FIGS. 3 and 4, each of the left wall 30, right wall 32, and the rear wall 34 terminates at its top end at a laterally extending flange. In particular, the left wall 30 comprises a left flange 52, the right wall 32 comprises a right flange 54, and the rear wall 34 comprises a rear flange 56. As is apparent from the figures, the left flange 52 is contiguous with the rear flange 56, which is also contiguous with the right flange 54. As indicated most clearly in FIG. 3, the left and right flanges 52, 54 extend beyond the support tray 24 to the front panel 26. As is also most clear from FIG. 3, extending laterally outward from the left flange 52 along both the support tray 24 and the front panel 26 is a continuous tongue 58 that is adapted to be received by the right flange of an identical ink container support 12 and, at least partly, by a groove of the right flange (see FIG. 5). Accordingly, multiple ink container supports 12 can be aligned side-by-side in a nested configuration, if desired.

The front panel 26 will now be described in relation to FIGS. 3 and 4. With reference first to FIG. 3, the front panel 26 comprises a generally planar front surface 60 that includes openings 62 for user notification lights, such as light emitting diodes (LEDs) and a space 64 reserved for a label that identifies the color of ink that is within the ink container supported by the ink container support 12. Extending inward from the front surface 60 is a recess 66 that is adapted to both retain and support the supply connector 20 shown in FIGS. 1 and 2.

As indicated in FIG. 3, the recess 66 is defined by a base 67, opposed curved lateral walls 68, and a rear wall 70. In addition, the recess 66 is defined by opposed lateral connector support elements 72 that extend upward from the base 67, inward from the lateral walls 68, and outward from the rear wall 70. The support elements 72 comprise curved top surfaces 74 that are specifically sized and configured to approximate the contours of the supply connector 20 so that the connector can be supported by the support elements 72 and the base 67 when not in use (see FIG. 2). The front panel 26 further comprises an elongated aperture 76 that extends through the base and through which the supply tube 22 of the supply connector 20 may pass. Because the aperture 76 forms a closed loop, the supply tube 22 and its supply connector 20 are retained by the ink container support 12 and cannot be pulled away from the ink container support 12 unless they are separated. With reference to FIG. 3, the front panel 26 further comprises pitched top surfaces 78 that extend down from the front wall 36 of the support tray 24 to the front surface 60 of the front panel.

Figure 5:
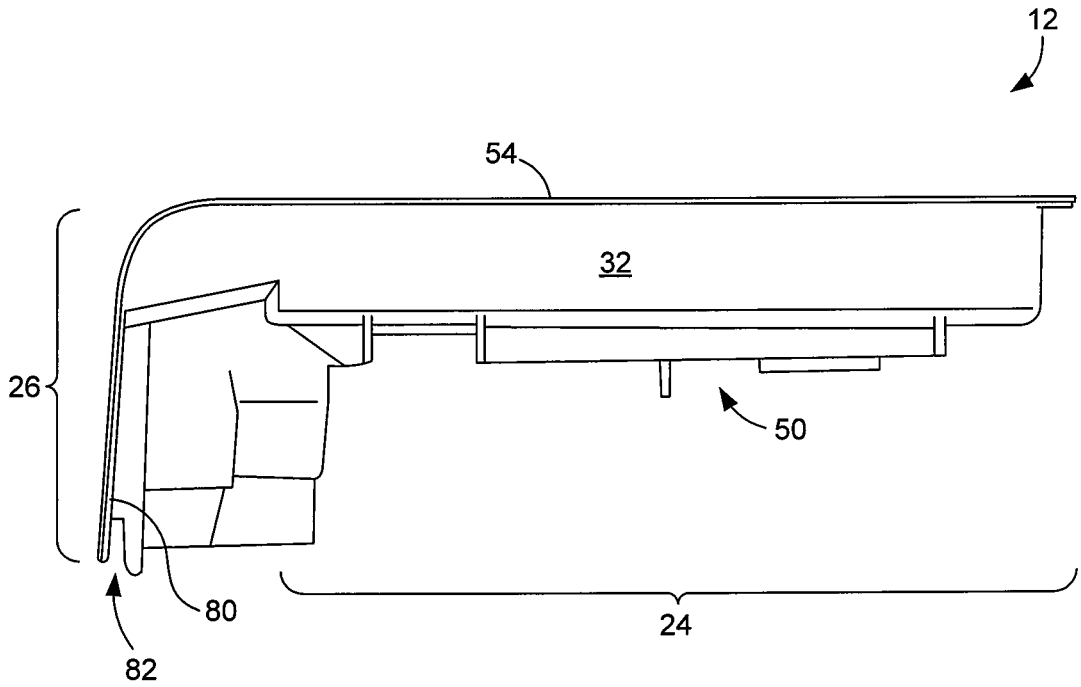
FIG. 5 is a side view of the ink container support shown in FIG. 1.

FIG. 5 illustrates the ink container support 12 from the right side. From that angle, the groove 80 described in the foregoing is visible. Part of the above-described tongue 58 of an identical ink container support can be received by the groove 80 at the front panel 26, and the remainder of the tongue can simply be tucked in below the right flange 54 along the support tray 24. Also, visible in FIG. 5 is a transverse slot 82 that extends from one side of the front panel 26 to the other that is adapted to receive an edge of a printer housing panel. In some cases, such panels have rough and unsightly edges. Therefore, the slot 82 serves both a safety and aesthetics function.

As described above, the ink container support 12 can be used to support an ink container, such as container 14 illustrated in FIG. 1. It is noted, however, that alternative, for example smaller, containers can be supported by the support 12. By way of example, the ink container 14 is a five liter container, and the support 12 can further support three liter containers. The footprint 84 of an example three liter container is identified by dashed lines 84 in FIG. 4. As shown in that figure, a rear edge of such a container can be positioned at the bottom edge of an incline 86 formed in each rear support element 40.

The invention claimed is:

1. An ink container support comprising:

a support tray adapted to support an ink container; and a front panel associated with the support tray, the front panel being adapted to facilitate user interfacing with the ink container when supported by the support tray, wherein the support tray comprises a pan and multiple walls that extend up from the pan, wherein the pan comprises container support elements that extend up from a surface of the pan, the container support elements being adapted to support the ink container above the pan surface, and wherein the container support elements include recesses in which are provided mounting holes used to secure the ink container support to a printer.

2. The ink container support of claim 1, wherein the pan further comprises a drain hole and wherein the pan slopes down toward the drain hole.

3. The ink container support of claim 1, further comprising flanges that extend outward from top ends of the walls of the support tray.

4. The ink container support of claim 3, further comprising a tongue that extends outward from one of the flanges, the tongue being adapted to be received by a groove of a flange of an identical ink container support when the ink container supports are positioned next to each other.

5. The ink container support of claim 1, wherein the front panel includes a front surface that has openings for user notification lights and a space for a label that identifies an ink color.

6. The ink container support of claim 5, wherein the front panel further comprises a recess that extends inward from the front surface.

7. The ink container support of claim 6, wherein the recess is defined by a base and multiple walls that extend upward from the base.

8. The ink container support of claim 7, wherein the base includes an aperture through which a supply tube used to deliver ink from the ink container to a printer can pass.

9. The ink container support of claim 8, wherein the front panel further comprises connector support elements positioned adjacent the aperture, the connector support elements being adapted to support a supply connector that is connected to the supply tube.

10. The ink container support of claim 5, wherein the front panel further comprises a transverse slot adapted to receive a panel of a printer to which ink is to be supplied.

11. An ink container support for use with a large format printer, the ink container support comprising:

a support tray adapted to support a bag-in-box ink container, the support tray including a pan and multiple walls that extend up from the pan, the pan comprising a drain hole and container support elements that extend up from a surface of the pan, the container support elements being adapted to support the bag-in-box ink container above the pan surface; and a front panel extending from the support tray, the front panel comprising a front surface and a recess that extends inward from the front surface, the recess being defined by a base and multiple walls that extend upward from the base, the base including an aperture through which a supply tube used to deliver ink from the bag-in-box ink container to a printer can pass, the front panel further comprising connector support elements positioned adjacent the aperture that are adapted to support a supply connector that is connected to the supply tube, wherein the container support elements include recesses in which are provided mounting holes used to secure the ink container support to a printer.

12. The ink container support of claim 11, further comprising flanges that extend outward from top ends of the walls of the support tray and outward from the front surface of the front panel and a tongue that extends outward from one of the flanges, the tongue being adapted to be received by a groove of a flange of an identical ink container support when the ink container supports are positioned next to each other in the printer.

* * * * *